US010378297B2

(12) United States Patent
Vander Velde

(10) Patent No.: US 10,378,297 B2
(45) Date of Patent: Aug. 13, 2019

(54) COILED TUBING VENTURI JUNK BASKET TOOL AND METHOD OF USE

(71) Applicant: Oil & Gas Tech Enterprises C.V., Noordwijk (NL)

(72) Inventor: Scott Vander Velde, Calgary (CA)

(73) Assignee: Oil & Gas Tech Enterprises C.V., Noordwijk (NL)

( * ) Notice: Subject to any disclaimer, the term of this patent is extended or adjusted under 35 U.S.C. 154(b) by 227 days.

(21) Appl. No.: 15/471,347

(22) Filed: Mar. 28, 2017

(65) Prior Publication Data

US 2018/0283118 A1 Oct. 4, 2018

(51) Int. Cl.

| | |
|---|---|
| ***E21B 31/12*** | (2006.01) |
| ***E21B 27/00*** | (2006.01) |
| ***E21B 41/00*** | (2006.01) |
| ***E21B 37/10*** | (2006.01) |

(52) U.S. Cl.

CPC ..... *E21B 27/00* (2013.01); *E21B 31/125* (2013.01); *E21B 37/10* (2013.01); *E21B 41/0078* (2013.01)

(58) Field of Classification Search

CPC ..... E21B 31/12; E21B 31/125; E21B 27/00; E21B 27/005; E21B 41/0078

See application file for complete search history.

(56) References Cited

U.S. PATENT DOCUMENTS 6,640,904 B2 * 11/2003 Hoffman ..... E21B 23/04 166/167

6,848,507 B2 * 2/2005 Huggins ..... E21B 31/125 166/301

* cited by examiner

*Primary Examiner* — Catherine Loikith

(74) *Attorney, Agent, or Firm* — Schmeiser, Olsen & Watts LLP

(57) ABSTRACT

A coiled tubing venturi junk basket tool retrieves junk, debris and/or wireline from a wellbore. A collection housing or waste basket is removeably coupled to the venturi body. The collection housing (waste basket) is customizable for volume, hole diameter and the type of junk and debris retrieved. An elastomeric trap is used to retain junk and debris in the collection housing. The collection housing is also interchangeable with a grab housing for retrieving wireline.

10 Claims, 4 Drawing Sheets

COILED TUBING VENTURI JUNK BASKET TOOL AND METHOD OF USE

BACKGROUND OF THE INVENTION

Technical Field

This invention relates generally to a coiled tubing venturi junk basket tool and to a method of retrieving junk, debris and/or wireline out of a wellbore.

State of the Art

A coiled tubing (CT) venturi junk basket is a tool which is used to retrieve junk and debris out of the wellbore. When fluid is pumped through the string of the coiled tubing and out through the nozzles in the venturi chamber, a vacuum is created in the venturi chamber. Fluid is sucked from the bottom of the tool exit back through the venturi tubes. Most of this fluid mixes with the pressurized fluid to be recirculated around the bottom of the tool.

The tool is essentially a high powered vacuum cleaner that may be used with fluid, nitrogenated fluids or gases. The nozzles in the tool are changed out for the available pump rate, fluid or gas. A debris filter screen is placed before the venturi chamber to prevent debris from blocking the venturi tubes. Waste basket extensions may be available to increase the volume of junk which may be carried. In some cases, the entire tool may need to be changed if different sized filter screens and traps are needed to recover specific sizes of debris, junk and/or wireline.

Generally, coiled tubing venturi junk basket tools use a metal flapper and/or finger type traps to retain debris in the collection housing. These metal hinged flaps or fingers tend to bind or break, allowing debris to fall back out of the collection housing and into the wellbore or preventing debris from entering the collection housing at all.

Therefore, it is desirable to have a customizable coiled tubing venturi junk basket tool based on the retrieval application (debris, junk and/or wireline). Further, it is desirable to have a collection housing that does not fail.

DISCLOSURE OF THE INVENTION

Disclosed herein is a coiled tubing venturi junk basket tool comprising a venturi body having a jet nozzle and a venturi throat; and a housing removeably coupled to the venturi body. The housing may be a collection housing having a trap. The trap may be an elastomeric material. The housing may also be a grab housing having a wireline grab. The wireline grab may be a fish hook wireline grab.

Disclosed herein is a method of retrieving junk and debris from a wellbore comprising pumping well fluid through a coiled tubing venturi junk basket tool having a tool body removeably coupled to a collection housing, wherein the collection housing comprises a trap; allowing the junk and debris to pass through the trap, wherein when the pumping is stopped, back flow of the well fluid and pressure collapses the trap thereby trapping the junk and debris. The trap may be an elastomeric material. The collection housing may be uncoupled and a grab housing may be removeably coupled to the tool body.

Disclosed herein is a method of retrieving wireline from a wellbore comprising retrieving wireline from a wellbore using a coiled tubing venturi junk basket tool having a tool body removeably coupled to a grab housing, wherein the grab housing comprises a wireline grab. The wireline grab may be a fish hook wireline grab. The grab housing may be uncoupled and a collection housing having a trap may be removeably coupled to the tool body.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a coiled tubing venturi junk retrieval tool having a removeably coupled collection (waste basket) housing and/or grab housing.

The coiled tubing venturi junk basket tool according to the invention is a coiled tubing venturi retrieval tool that is designed to remove debris, junk and/or wireline from a wellbore. Fluid is pumped through the string of coiled tubing and out through the venturi nozzles which creates a vacuum within the venturi tool. Wellbore fluid is then sucked through the venturi tool and any solids contained within the tool are trapped in the collection housing between a filter screen and an elastomeric trap. When the pumps are shut down, the debris, junk and/or fill is trapped in place by the elastomeric trap at the bottom of the venturi tool. Different sized extensions can also be fitted to recover larger volumes/sizes of debris and/or junk if required.

The coiled tubing venturi junk basket tool can also be run with a washover shoe below a motor for specific operations where rotation is required such as washing over a fish hook. The tool's adjustable nozzles are easily changed to adjust the activation flow rate and pressure to suit each application.

The elastomeric trap as disclosed herein does not have mechanical hinges which may fail. The elastomeric trap comprises an elastomeric check valve. Suitable elastomeric materials including, but not limited to, rubber, nitrile, and/or fluoroelastomer, such as Viton™, may be used. The flexibility of the elastomeric trap allows junk and debris to pass through and into the trap. When pumping is stopped, the back flow of well fluid along with pressure collapse the opening of the elastomeric trap thereby trapping the junk and debris.

The coiled tubing venturi junk basket tool according to the invention incorporates a venturi tool body separate from the collection (waste basket) housing and/or grab housing. The separate collection housing and/or grab housing allows customization based on retrieval application. The collection housing (waste basket) can be configured for volume, hole diameter (wellbore, tubing and/or casing) and the type and size of junk and debris being retrieved therefrom. For example, a larger trap opening may be used without changing the entire tool configuration.

In another embodiment, the collection housing may be replaced by a grab housing for retrieving wireline, such as a fish hook grab housing. The jet/venturi can be configured to provide a wash over application while attempting to recover the wire. The upper portion of the tool (venturi portion) remains the same. Depending on the operation (either junk retrieval or wireline retrieval), the lower portion of the tool changes.

Figure 1:
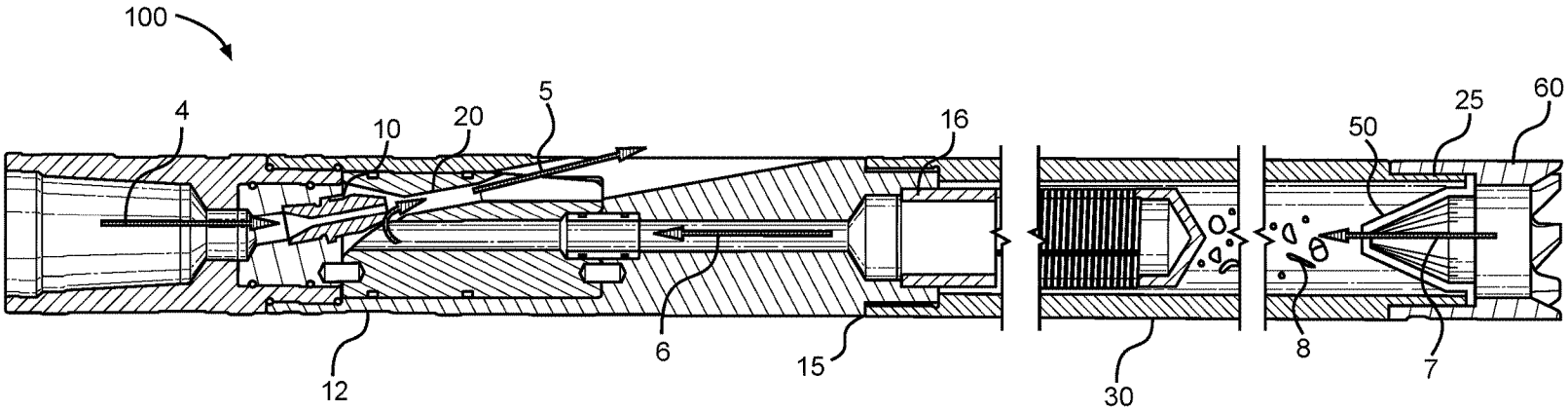
FIG. 1 is a longitudinal cross sectional view of one embodiment of a coiled tubing venturi tool according to the invention.

As shown in FIG. 1, a coiled tubing venturi junk basket tool 100 includes a venturi body 12 having a venturi jet nozzle 10 and a venturi throat 20. A cylindrical housing 30 is a collection (waste basket) housing 30 which encompasses a down hole filter (screen) 40 and carries a trap 50. Collection (waste basket) housing 30 is threadably coupled at threaded connection 15 to venturi body 12. Likewise, filter 40 is threadably coupled to venturi body 12 at 16 as shown in FIG. 1. A collection head 60, such as a mill face collection head having a standard flat face, is threadably coupled to cylindrical housing 30 at 25.

The solid large arrows (4, 5, 6 and 7) show the direction of fluid flow within, out of and into the coiled tubing venturi junk basket tool. The coiled tubing venturi junk basket tool 100 collects well fluid and solids (junk and debris) 7 by vacuuming up the combination well fluid and solids 7 and collecting solids 8. The well fluid 6 is allowed to pass through downhole filter (screen) 40. Mixed fluid 5 (venturi drive fluid 4 from the surface along with well fluid 6) is jetted back out of the coiled tubing venturi junk basket tool 100. The solids (debris and junk) 8 are kept inside the waste basket housing and are prevented from falling back out the bottom of the tool by the trap 50.

Figure 2:
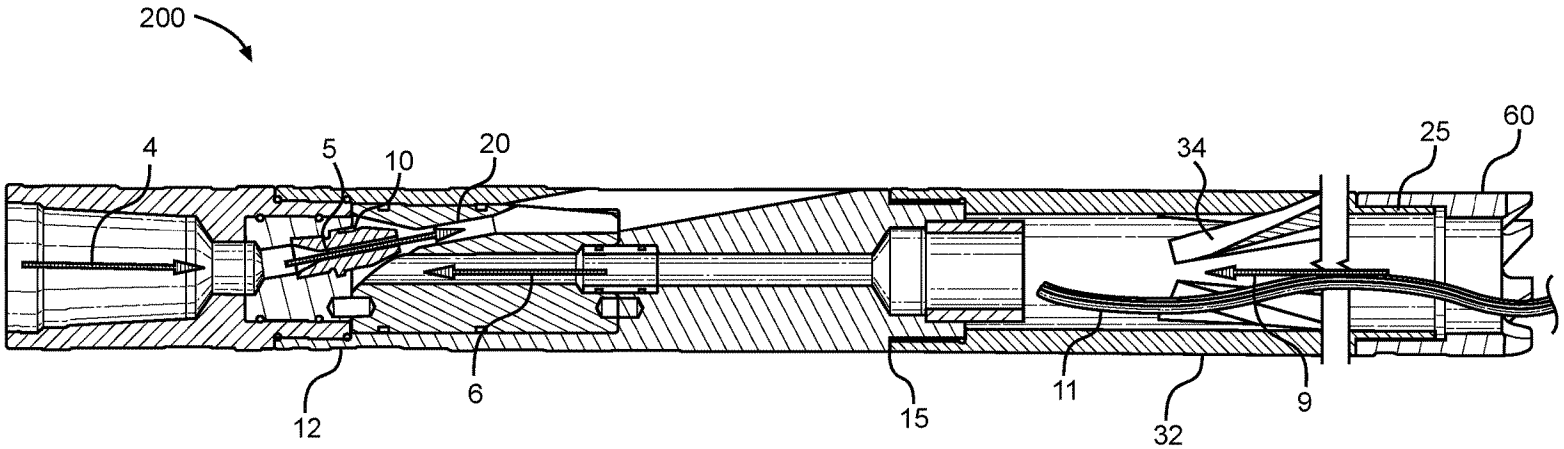
FIG. 2 is a longitudinal cross section view of one embodiment of a coiled tubing venturi tool according to the invention.

In an embodiment to retrieve wireline as shown in FIG. 2, the collection (waste basket) housing 30 is replaced by a grab housing 32 including at least one fish hook wireline grab 34. An elastomeric trap is not needed as it would be difficult to close because of the wire. A downhole filter may or may not be used in conjunction with the at least one fish hook wireline grab 34.

As shown in FIG. 2, coiled tubing venturi junk basket tool 200 includes venturi body 12 having venturi jet nozzle 10 and venturi throat 20. Cylindrical housing 32 is a grab housing having at least one fish hook wireline grab 34. Grab housing 32 is coupled to venturi body 12 by a threaded connection 15. Collection head 60, such as a mill face collection head having a standard flat face, is coupled to grab housing 32 by a threaded connection 25.

The solid large arrows (4, 5, 6 and 9) show the direction of fluid flow within, out of and into the coiled tubing venturi junk basket tool 200. Coiled tubing venturi junk basket tool 200 collects well fluid and wireline 11 by vacuuming up the combination well fluid and wireline 11 and grabbing wireline 11. Well fluid 6 may optionally pass through a downhole filter (screen). Mixed fluid 5 (venturi drive fluid 4 from the surface along with well fluid 6) is jetted back out of the CT venturi junk basket tool 200.

Figure 3A:
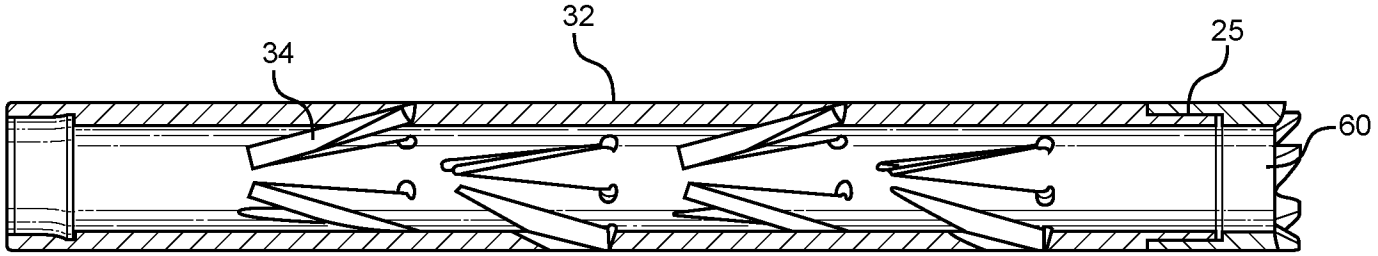
FIG. 3A is a cross sectional view of one embodiment of a housing according to the invention.
Figure 3B:
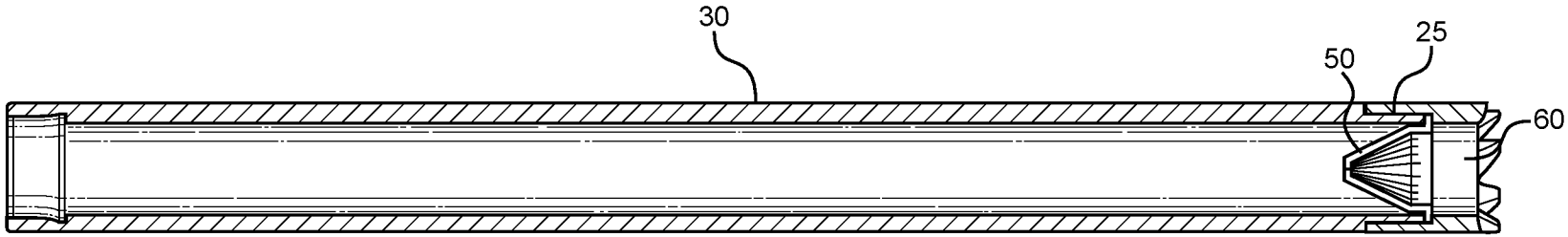
FIG. 3B is a cross sectional view of one embodiment of a housing according to the invention.

Cross sectional views of the cylindrical housings collection (waste basket) housing 30 and grab housing 32 are shown in FIGS. 3A-3D. As shown in FIG. 3A, grab housing 32 includes multiple fish hook wireline grabs 34 (number each) coupled to collection head 60 by threaded connection 25. FIG. 3B shows collection (waste basket) housing 30 and trap 50 coupled to collection head 60 by threaded connection 25.

Figure 3C:
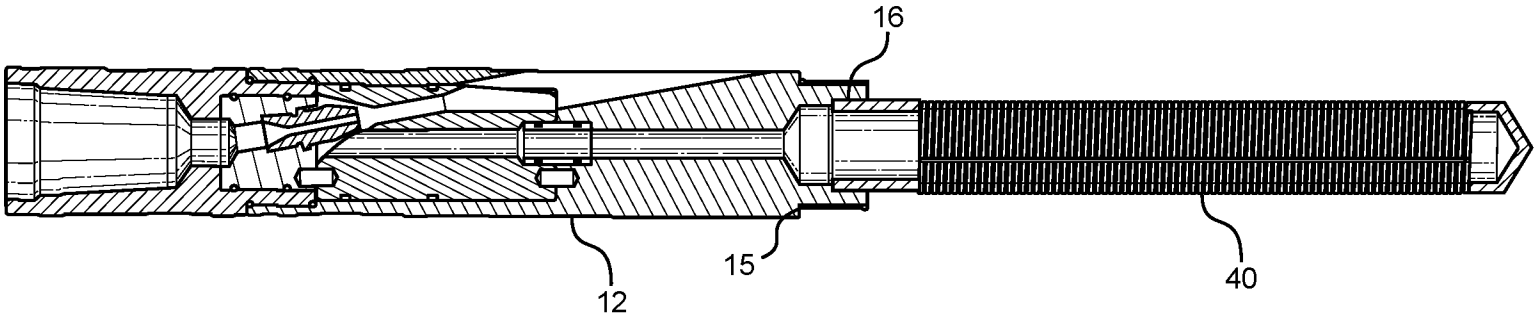
FIG. 3C is a cross sectional view of one embodiment of a housing according to the invention.
Figure 3D:
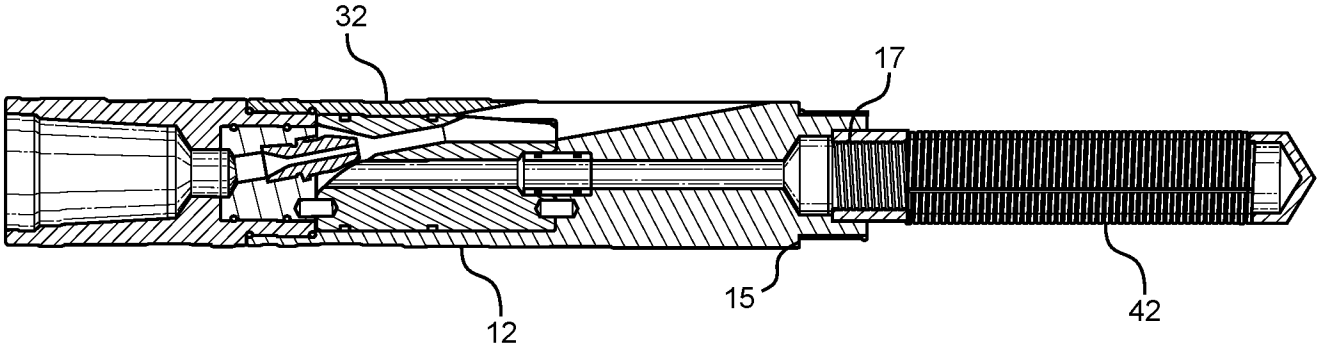
FIG. 3D is a cross sectional view of one embodiment of a housing according to the invention.

FIG. 3C shows venturi body 12 threadably coupled to downhole filter 40 at connection 16. FIG. 3D shows venturi body 12 threadably coupled to optional downhole filter 42 at 17. (Cylindrical housings collection (waste basket) housing 30 and grab housing 32 have inner threaded connections (portions) 16 and 17, respectively. Cylindrical housings collection (waste basket) housing 30 and grab housing 32 are interchangeable and removeably coupled to venturi body 12 via outer thread connection (portion) 15 and inner thread connection (portion) 16 or inner thread connection (portion) 17, respectively.

Figure 4A:
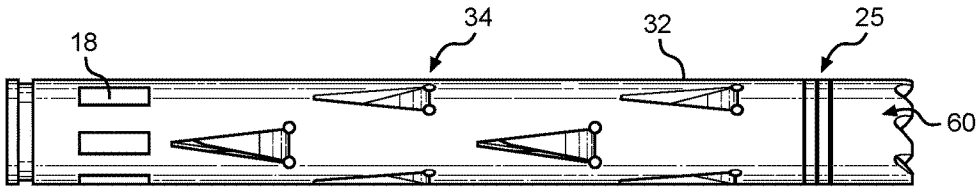
FIG. 4A is a plan view of one embodiment of a housing according to the invention.
Figure 4B:
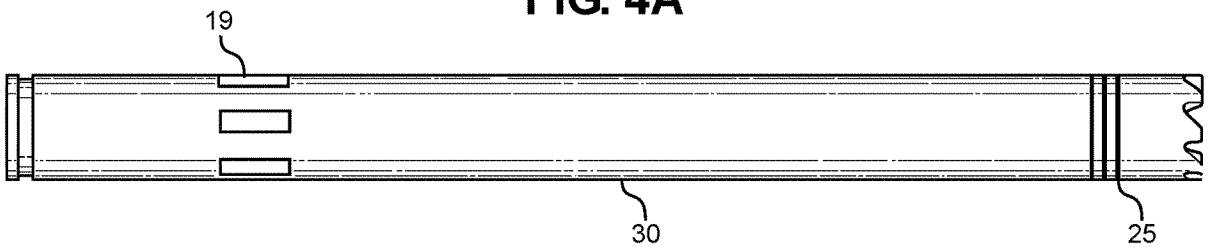
FIG. 4B is a plan view of one embodiment of a housing according to the invention.

FIGS. 4A-4D illustrate the outer surface of the cylindrical housings, collection (waste basket) housing 30 and grab housing 32. As shown in FIG. 4A, grab housing 32 includes multiple fish hook wireline grabs 34 coupled to collection head 60 by threaded connection 25. The outer surfaces of collection (waste basket) housing 30 (FIG. 4B) and grab housing 32 include indentations 18 and 19, respectively. Indentations 18 and 19 aid in grabbing venturi body 12. FIG. 4B shows collection (waste basket) housing 30 and trap 50 coupled to collection head 60 by threaded connection 25.

Figure 4C:
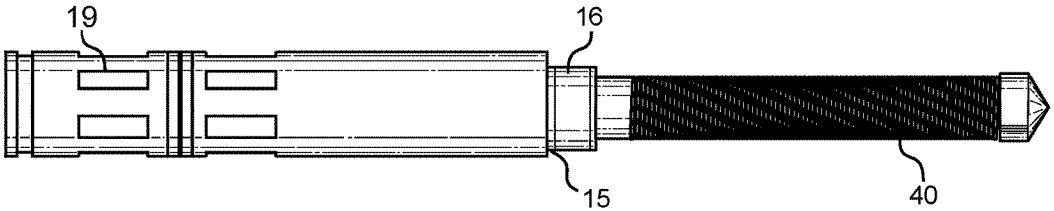
FIG. 4C is a plan view of one embodiment of a housing according to the invention.
Figure 4D:
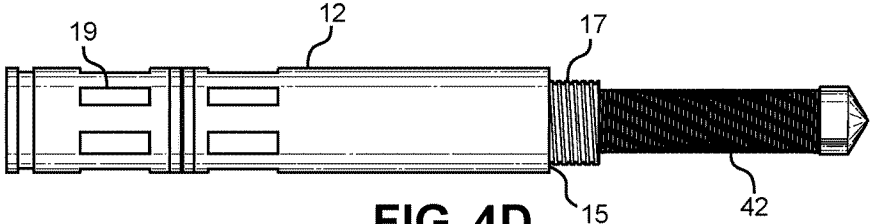
FIG. 4D is a plan view of one embodiment of a housing according to the invention.

FIG. 4C shows venturi body 12 threadably coupled to downhole filter 40 at 16. FIG. 4D shows venturi body 12 threadably coupled to optional downhole filter 42 at 17. Cylindrical housings collection (waste basket) housing 30 and grab housing 32 have inner threaded connections (portions) 16 and 17, respectively. Cylindrical housings collection (waste basket) housing 30 and grab housing 32 are interchangeable with venturi body 12 via outer thread connection (portion) 15 and inner thread connection (portion) 16 or inner thread connection (portion) 17, respectively.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of retrieving junk and debris from a wellbore comprising:

pumping well fluid through a coiled tubing venturi junk basket tool having a tool body removably coupled to a collection housing, wherein the collection housing comprises a trap;

allowing the junk and debris to pass through the trap, wherein when the pumping is stopped, back flow of the well fluid and pressure collapses the trap thereby trapping the junk and debris; and uncoupling the collection housing and removably coupling a grab housing to the tool body.

2. The method of claim 1, wherein the grab housing comprises at least one wireline grab.

3. The method of claim 2, wherein the wireline grab is a fish hook wireline grab.

4. The method of claim 1, wherein the trap is an elastomeric material.

5. The method of claim 4, wherein the elastomeric material is selected from the group consisting of rubber, nitrile, fluoroelastomer and/or mixtures thereof.

6. A method of retrieving wireline from a wellbore comprising:

retrieving wireline from a wellbore using a coiled tubing venturi junk basket tool having a tool body removably coupled to a grab housing, wherein the grab housing comprises at least one wireline grab; and uncoupling the grab housing and removably coupling a collection housing having a trap to the tool body.

7. The method of claim 6, wherein the wireline grab is a fish hook wireline grab.

8. The method of claim 6, wherein the trap is an elastomeric material.

9. The method of claim 8, wherein the elastomeric material is selected from the group consisting of rubber, nitrile, fluoroelastomer and/or mixtures thereof.

10. The method of claim 6, wherein the trap is an elastomeric check valve.

* * * * *